United States Patent [19]

Villarreal

[11] Patent Number: 4,755,806

[45] Date of Patent: Jul. 5, 1988

[54] MOVEMENT SENSOR

[76] Inventor: Juan M. Villarreal, 709 Nebraska, Robstown, Tex. 78380

[21] Appl. No.: 23,675

[22] Filed: Mar. 9, 1987

[51] Int. Cl.[4] ..... G08B 21/00; G08B 13/14

[52] U.S. Cl. ..... 340/689; 340/568; 340/572; 340/686

[58] Field of Search ..... 340/540, 571, 572, 568, 340/683, 689, 690, 566, 691, 501; 200/61.39, 61.52, 153 N, 187, 224, 236, 215

[56] References Cited

U.S. PATENT DOCUMENTS

| | | | |
|---|---|---|---|
| 3,879,703 | 4/1975 | Bonazoli et al. | 340/689 |
| 4,275,391 | 6/1981 | Okamura | 340/571 |
| 4,284,983 | 8/1981 | Lent | 340/571 X |
| 4,385,288 | 5/1983 | Bitko | 340/571 |
| 4,414,541 | 11/1983 | Ho | 340/571 X |
| 4,450,437 | 5/1984 | Ho | 340/540 |

*Primary Examiner*—Joseph A. Orsino, Jr.
*Assistant Examiner*—Tat K. Wong
*Attorney, Agent, or Firm*—G. Turner Moller

[57] ABSTRACT

A motion sensor comprises a beam having a level switch mounted thereon in a horizontal position. When the sensor is moved, the beam tilts causing the level switch to activate an alarm or remote device. Also in response to tilting, a motor is energized to move the beam back to its original horizontal position. In a first embodiment, two level switches control one motor. In a second embodiment, one level switch controls two motors. In other embodiments, pendulum type switches are employed.

15 Claims, 4 Drawing Sheets

MOVEMENT SENSOR

BACKGROUND OF THE INVENTION

This invention relates to a device which senses or detects movement of the device itself or an object on which the device is placed.

There are a number of situations where it may be desirable to detect movement of an object. One category of situations involves security or protection of an item which is of a type prone to be stolen. Some of these situations occur outdoors, such as unattended vehicles and construction materials. Some occur indoors, such as VCR's, TV sets, stereo equipment, computers and the like. In accordance with this invention, a movement sensor is placed on or attached to the item. When the item is moved, the sensor detects the movement and actuates an alarm.

Another situation where the device of this invention may be useful is in a game or entertainment device where the object of the game is to move the device from a first location to a second location without tilting the device sufficiently to energize an alarm.

Mercury filled level switches have been used as motion detectors, as shown in U.S. Pat. No. 2,041,577. The concept of providing a movement sensor that does not require spatial adjustment is found in U.S. Pat. No. 4,057,791.

SUMMARY OF THE INVENTION

It is an object of this invention to provide a sensor which is capable of detecting movement thereof.

Another object of this invention is to provide an improved movement sensor which detects rotational or tilting movement of the sensor from a first angular position and which automatically resets after being tilted.

Other objects and advantages of this invention will become more fully apparent as this description proceeds, reference being made to the accompanying drawing and appended claims.

DESCRIPTION OF THE PREFERRED EMBODIMENT

Figure 4:
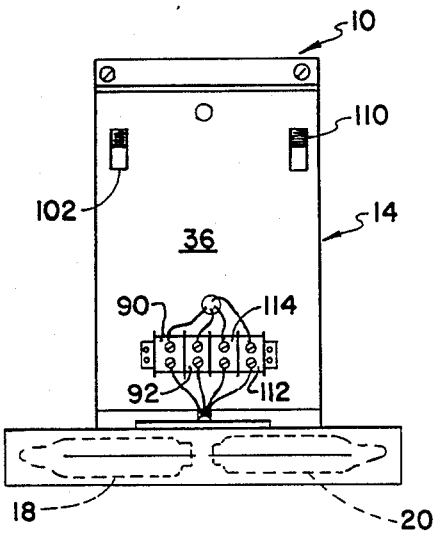
FIG. 4 is a top plan view of the movement sensor of FIGS. 1–3.

Referring to FIGS. 1–9, there is illustrated a movement sensor or detector 10 of this invention comprising, as major components, a base 12 having a cover 14, an element or beam 16 carrying one or more mercury filled level switches 18, 20, a motor 22, a gear reducer 24 and a circuit 26 connecting the switches 18, 20 and motor 22. The sensor 10 may be placed inside the item to be protected, e.g. inside a TV set or VCR. Alternatively, the sensor 10 may be incorporated in a decorative item, e.g. flower pot, to be placed on the item to be protected.

The base 12 may be of any suitable type and is illustrated as a generally flat plate 28 having a series of feet 30 which preferably comprise a threaded fastener. The threaded fasteners may extend into threaded openings (not shown) provided by the object to which the motion sensor 10 is attached. The plate 28 includes a forward upturned end 34 which is of slightly irregular pentagonal shape as shown best in FIGS. 1 and 2.

The cover 14 is generally rectangular in shape providing a top 36, sides 38, and ends 40. An angle 42 connects to the rear end 40 and receives the fasteners for securing the cover 14 to the base 12. The forward end of the cover 14 is likewise secured to the base 12 in any suitable fashion.

The element 16 comprises a hollow box shaped beam having the level switches 18, 20 secured therein in a suitable manner. The beam 16 is mounted on base 12 for rotational movement about a generally horizontal axis 43. To this end, the beam 16 is attached, as by threaded fasteners 44, to an output gear 46 of the gear reducer 24 as more fully pointed out hereinafter.

Figure 8:
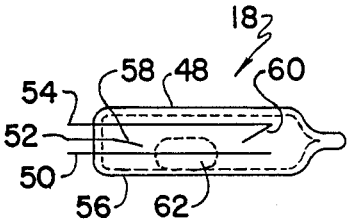
FIG. 8 is a schematic view of a level switch of the type used in the embodiment of FIGS. 1–7.
Figure 6:
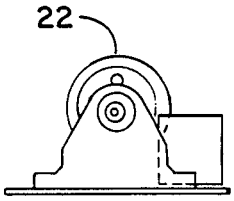
FIG. 6 is a transverse cross-sectional view of the device of FIG. 5, taken substantially along line 6—6 as viewed in the direction indicated by the arrows.

The level switches 18, 20 are conveniently identical and may be of any suitable type. A typical switch 18 is illustrated in FIG. 8 and comprises a hollow slightly elongate glass envelope 48 having a series of conductors 50, 52, 54 extending through one end thereof. The lower conductor 50 extends for most of the length of the envelope 48. The intermediate conductor 52 is quite short and extends only a short distance from the end wall 56 and provides a slightly downturned end 58. The upper conductor 54 extends for most of the length of the envelope 48 and provides a similar downturned end 60. A drop 62 of electrically conductive liquid, usually mercury, moves along the bottom of the envelope 48 depending on the inclination of the envelope to the earth. It will be evident that when the drop 62 moves to the left in FIG. 8, an electrical connection is made between the conductors 50, 52. As the drop 62 moves to the right in FIG. 8 out of contact with the short conductor 52, neither of the conductors 52, 54 are in contact with the conductor 50. As the drop 62 approaches the right end of the envelope 48, an electrical connection is made between the conductors 50, 54.

It might be thought that the switches 18, 20 detect the horizontal position because the conductive drop 62 comes to rest in the center of the envelope 48. Movement of the drop 62 inside the envelope 48 is extremely sensitive and the adjustment of the beam 16 to center the drop 62 is not readily accomplished. Although centering the drop 62 might be feasible if a recess were provided in the bottom of the envelope, the switches 18,

20 determine the horizontal position by a different technique.

When both switches 18, 20 are inclined in a given direction, the circuit 26 actuates the motor 22 to tilt the beam 16 in the opposite direction. When the beam 16 is moved until the switch 18 tilts in one direction and the switch 20 tilts in the other direction, the circuit 26 shuts off the motor 22 and the beam 16 is horizontal or very nearly so. Thus, the at rest position of the beam 16 occurs when one of the switches 18, 20 is closed in the other direction. This peculiarity will be more fully discussed hereinafter. It will thus be seen that the switches 18, 20 are capable of discriminating between a first angular switch position, usually horizontal, and a second angular position, usually inclined to the horizontal. As will be more fully pointed out hereinafter, this capability of the switches 18, 20 will be used to determine if the sensor 10 has been moved from its at rest position.

The motor 22 may be of any suitable type and is illustrated as a reversible small capacity dc electrical motor of the type commonly used in small motorized toys. The motor 22 is secured to the base plate 28 by suitable fasteners 64 and includes a rotating output 66 connected to an input 68 of the gear reducer 24 by an elongate sleeve 70.

Figure 7:
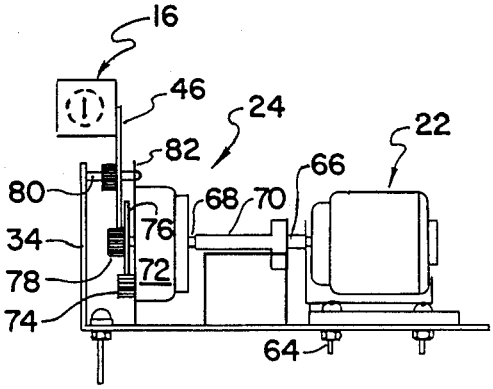
FIG. 7 is a longitudinal cross-sectional view of the device of FIG. 5, taken substantially along line 7—7 as viewed in the direction indicated by the arrows.

The gear reducer 24 may be of any suitable type and is illustrated in FIG. 7 as comprising a mechanical clock movement having a housing 70 having one or more gears (not shown) therein driving a spur gear 74 driving an idler gear 76 which in turns drives a spur gear 78 which drives the output gear 46. The output gear 46 is mounted on a shaft 80 journalled between the base end 34 and a bracket 82 carried by the housing 72 and is accordingly rotated about the axis 43.

Mounted adjacent the base front end 34 are a pair of limit switches 84, 86 which turn off power to the motor 22 in the event the sensor 10 is rotated by a very large angle and the motor 22 attempts to turn the beam 16 back to the horizontal. The switches 84, 86 accordingly merely comprise a safety measure to prevent damage to the motor 22. The switches 84, 86 are conveniently mounted on a brace 87 shown best in FIG. 2.

Figure 9:
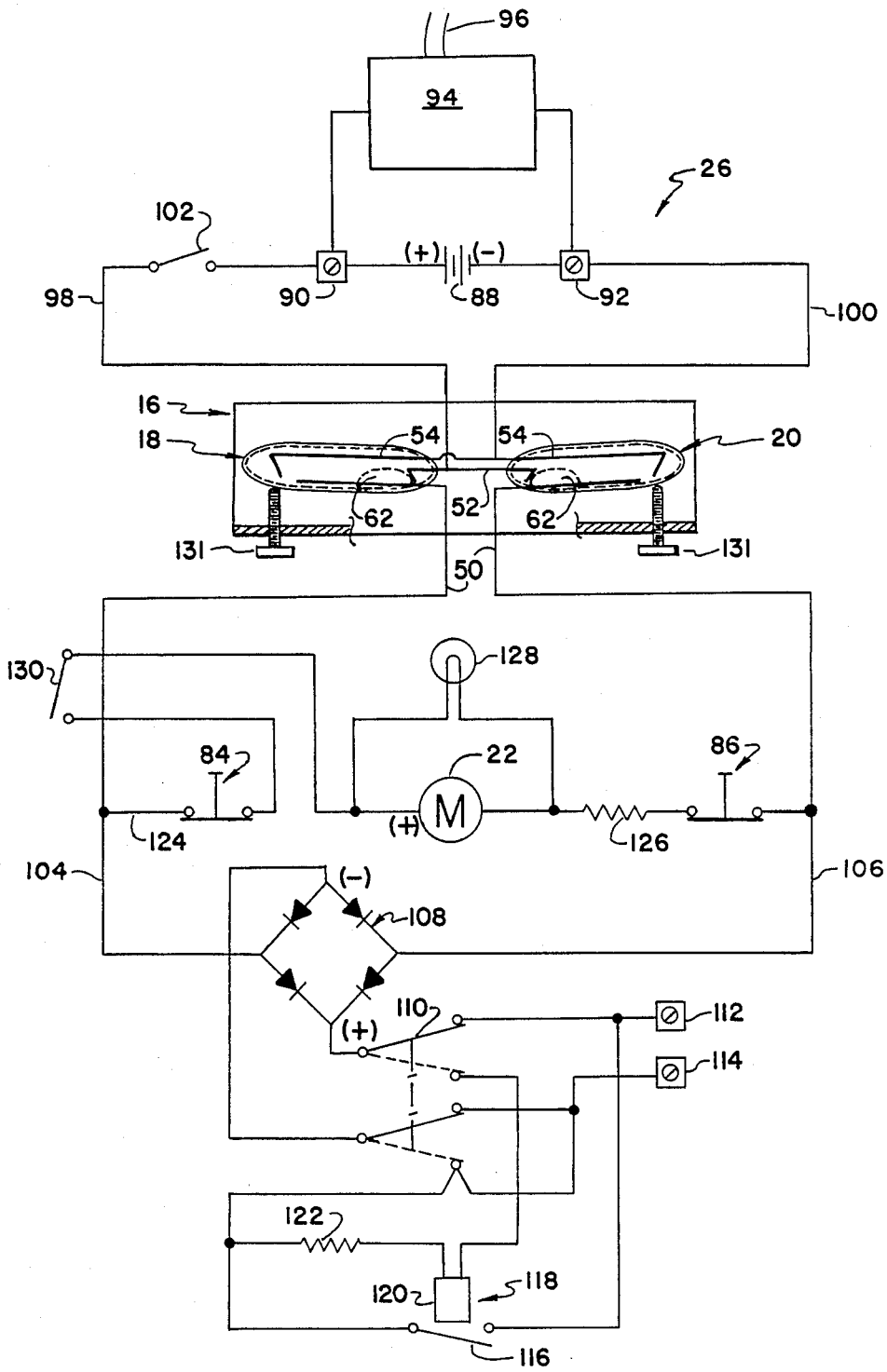
FIG. 9 is a circuit diagram of the circuitry in the embodiment of FIGS. 1–8 illustrating an at rest position.

Referring to FIG. 9, the circuit 26 is shown in detail in an at rest position. A battery 88 is connected to a pair of terminals 90, 92 on the outside of the cover 14. In the event the movement sensor 10 is to be employed in a long term arrangement, an ac-dc rectifier or battery charger 94 is desirably connected by leads 96 to a source of ac power. Wires 98, 100 lead from the terminals 90, 92 to the level switches 18, 20. An on-off switch 102 is in the wire 98. The wire 98 is connected to the intermediate conductors 52 of the first and second switches 18, 20. The wire 100 is connected to the upper conductors 54 of the first and second switches 18, 20. Because both switches 18, 20 are closed against the intermediate conductor 52, it will be evident that no power is being delivered to the motor 22 and the beam 16 is in its normal, at rest, horizontal position. The lower conductors 50 of both switches 18, 20 are connected by wires 104, 106 to a rectifier bridge 108 operating through a double pole double throw switch 110 to maintain a first alarm terminal 112 positive and a second alarm terminal 114 negative as may be desired in some alarm applications. Desirably, the alarm (not shown) incorporates a latching relay to keep the alarm energized until it is reset rather than relying on the tilt of the beam 16 to keep the alarm going.

If the item being protected is electrically powered, it may be desirable, in some situations, to connect its power circuit (not shown) to the circuit 26 so the device is disabled if it is moved. To this end, the switch 110 is shifted to its dashed line position to connect a pair of normally closed contacts 116 of a relay 118 to the terminals 112, 114. In the event the beam 16 is tilted, power is delivered through the wires 104, 106 to energize a relay coil 120 and resistor 122 to open the contacts 116 thereby disabling the electrically powered device connected to the terminals 112, 114.

The motor 22 and limit switches 84, 86 are connected in a conductor 124 extending between the wires 104, 106 for energizing the motor 22 when potential is present across the wires 104, 106. If needed, a resistor 126 may be provided to match the motor voltage to the power supply. If desired, a light 128 may be placed in parallel to the motor 22 and is energized simultaneously with the motor 22. The limit switches 84, 86 are connected in the conductor 124 to shut off power to the motor 22 in the event of overrotation of the beam 16.

Another feature of the invention is present in the conductor 124 and comprises an on-off switch 130. The switch 130 may be key operated or operated off a mechanism of the device being protected. For example, if the device being protected is a television set, the switch 130 may be positioned in the set to close when the channel selector is positioned to close on an unusual channel, e.g. channel 92. It will be seen that the motor 22 cannot be energized until the switch 130 is closed. Thus, to set the beam 16 in its normal horizontal position, the switch 130 has to be closed which can only be done by knowing what is to be done to close it. An ancillary advantage of the switch 130 is that the motor 22 does not automatically reset the beam 16 and turn off the alarm (not shown) attached to the terminals 112, 114. Premature turning off of the alarm (not shown) is normally accomplished by the use of a timer (not shown) or relay (not shown) keeping the alarm energized until the alarm itself is reset.

Figure 2:
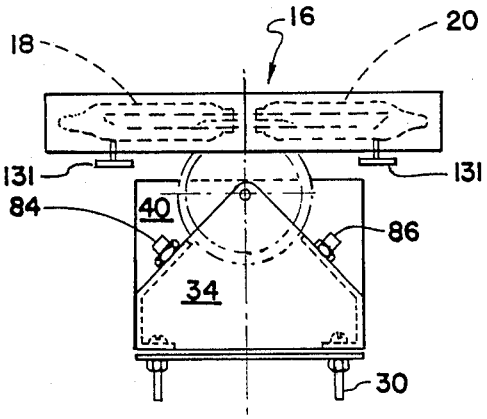
FIG. 2 is a front elevational view of the movement sensor of FIG. 1.
Figure 3:
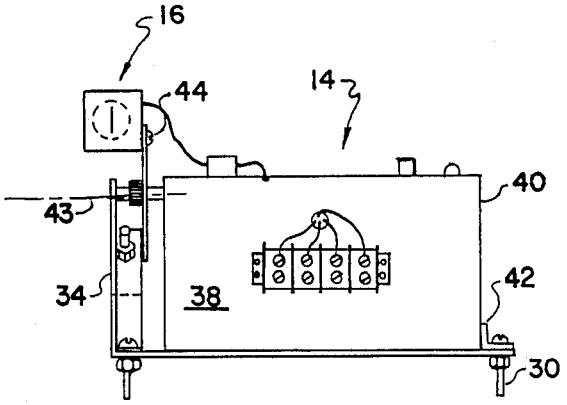
FIG. 3 is a side elevational view of the movement sensor of FIGS. 1–2.

The switches 18, 20 are illustrated in an exaggerated converging position inclined relative to each other. As shown in FIG. 2, adjustment screws 131 are provided to change the inclination of the switches 18, 20 relative to each other. These features are provided to adjust the sensitivity of the switches 18, 20 and thereby adjust the sensitivity of the movement sensor 10. With both switches 18, 20 exactly level and parallel, a very slight vibration may set one or both of the conductive drops 62 to moving thereby setting off the alarm to which the sensor 10 is attached. With the switches 18, 20 converging at a relatively large angle, e.g. 10°, the sensor 10 is relatively insensitive and will not actuate until its base has been tilted about 10°. As a practical matter, the switches 18, 20 converge at relatively small angles, e.g. 1°–2°. In the at rest position of FIG. 9, the switches 18, 20 are illustrating as converging downwardly toward the center of the beam 16. This technique works equally well if the switches 18, 20 are mounted to converge upwardly toward the center of the beam 16. The only difference is, in the at rest position, the conductive drops 62 close against both upper conductors 54.

Operation of the movement sensor 10 should now be apparent. The sensor 10 is placed on or attached to the item sought to be protected. The on-off switch 102 is closed, usually by a key operated mechanism, to energize the sensor 10. The switch 130 is likewise closed by whatever technique is designed into it. Usually, the beam 16 will not initially be horizontal so the level switches 18, 20 complete a connection from the wires 98, 100 to the wires 104, 106, depending on the direction the beam 16 is inclined. If the beam 16 is inclined down to the left as viewed in FIG. 9, the switch 18 completes a connection between the lower conductor 50 and the upper conductor 54 while the switch 20 remains in the position shown in FIG. 9, i.e. the conductors 50, 52 remain in contact. This energizes the motor 22 in a first direction of rotation and causes the output shaft 66 to rotate in a direction to rotate the beam 16 about the axis 43 in a direction to move the beam 16 toward its horizontal or at rest position.

If the beam 16 is tilted down to the right as viewed in FIG. 9, the switch 20 completes a connection between the lower conductor 50 and the upper conductor 54 while the switch 18 remains in the position shown in FIG. 9, i.e. the conductors 50, 52 remain in contact. This energizes the motor 22 is a second or opposite direction of rotation and causes the output shaft 66 to rotate in an opposite direction to rotate the beam about its axis 43 to move the beam toward its horizontal or at rest position.

The alarm or remote controlled device (not shown) is now attached to the terminals 112, 114 and the item sought to be protected is now wired. In the event the sensor 10 or the object to which it is attached is moved and tilted ever so slightly, the beam 16 tilts and the conductive droplets 62 of both switches 18, 20 move into contact with one or the other of the conductors 52, 54 thereby energizing the rectifier bridge 108 and consequently energizing the terminals 112, 114 to energize the alarm or remote controlled device (not shown).

Figure 10:
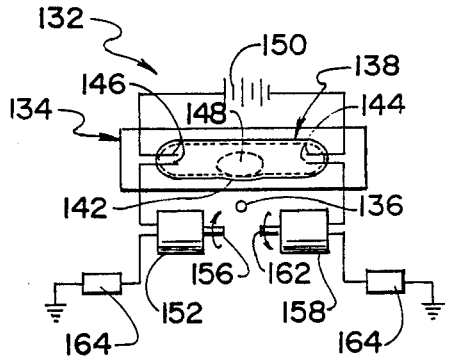
FIG. 10 is a schematic view of another embodiment of this invention.
Figure 5:
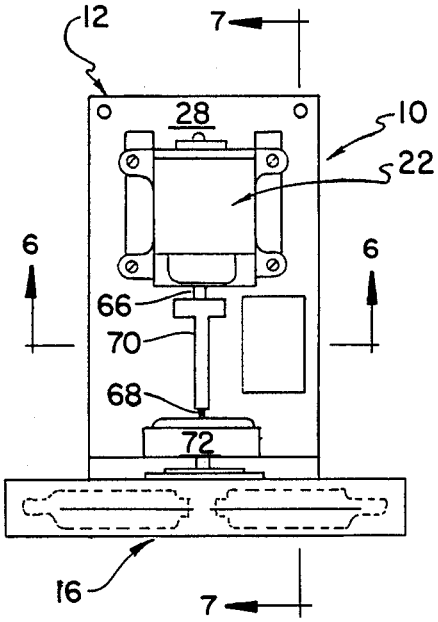
FIG. 5 is a top plan view of the embodiment of FIGS. 1–4, with the cover removed.

Referring to FIG. 10, another embodiment 132 of the invention is illustrated comprising a beam 134 mounted for rotation about an axis 136 and carrying thereon a single level switch 138 comprising an elongate generally cylindrical horizontal glass envelope 140 having a downwardly extending bulge 142 in the bottom thereof. Two pairs of conductors 144, 146 extend through opposite ends of the envelope 140. A drop 148 of conductive liquid, usually mercury, resides in a compartment inside the envelope 140 and provides electrical communication between the conductors 144, 146 if the switch 138 is tilted significantly.

A battery 150 is connected to one of the conductors 144, 146 at each end of the switch 138. A first motor 152 is connected to one of the conductors 146 and to a ground connection 154. The motor 152 provides an output shaft 156 for driving a gear reducer (not shown) to tilt the beam 134 in a first rotational direction back toward the horizontal in the event the beam 134 is tilted in the opposite direction. A second motor 158 is connected to one of the conductors 144 and to a ground connection 160. An output shaft 162 of the motor 158 drives the gear reducer (not shown) in a direction opposite from the shaft 156. An alarm or remote control device 164, 166 is placed in the circuit leading from the motors 152, 158 to ground to sound an alarm in the event the beam 134 is tilted. The circuitry of FIG. 10 is greatly simplified but may include all of the features of FIG. 9 if desired.

Operation of the motion sensor 132 is substantially identical to that of the sensor 10 and should now be apparent. When the sensor 132 is tilted, the conductive droplet 148 completes an electrical connection between one of the pair of conductors 144, 146, depending on the direction of tilt. The alarm or remote control device 164 is energized and one of the motors 152, 158 is energized to rotate the beam 134 back toward its original at rest position.

Figure 11:
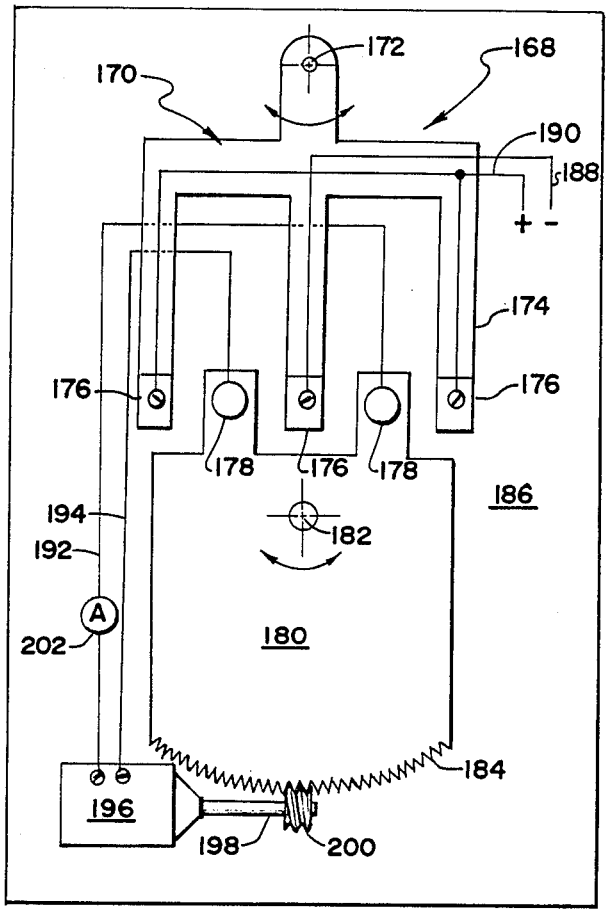
FIG. 11 is a schematic view of another embodiment of this invention.

Referring to FIG. 11, another embodiment 168 of the invention is illustrated comprising an element 170 mounted for rotation about an axis 172 and providing a series of downwardly extending arms 174 carrying thereon a switch contact or switch actuator 176. A pair of switch contacts 178 are mounted on a movable base 180 and extend forwardly therefrom to engage the switch contacts 176. The movable base 180 is mounted by suitable bearings (not shown) for rotatable movement about an axis 182 comprising a radius of a gear segment 184 carried by a stationary base 186.

A first conductor 188 connects to the central switch contact 176 and a second conductor 190 connects to the end contacts 176. The contacts 178 are connected by conductors 192, 194 to a motor 196 providing an output shaft 198 having a worm gear 200 thereon to move the movable base 180 to a position so the contacts 176 are out of engagement with the contacts 178. This allows the arm 174 to reassume its original vertical position with the switch contacts between and out of engagement with the contacts 178.

An alarm 202 may be provided in the circuit of the sensor 168 in any suitable manner, to be energized upon closing of the contacts 176, 178.

Operation of the movement sensor 168 should now be apparent. The sensor 168 is placed on or attached to the item sought to be protected. Usually, the arm 174 and movable base 180 are initially be positioned so the switch contacts 176, 178 complete a connection between the conductors 188, 190, 192, 194 depending on the direction the arm 174 is inclined relative to the movable base 180. If the movable base 180 is inclined so the vertical arm 174 is inclined to the left as viewed in FIG. 11, the center and right switch contacts 176 engage the contacts 178 to completes a connection between the conductors 188, 190 and the conductors 192, 194. This energizes the motor 196 in a first direction of rotation and causes the output shaft 198 to rotate in a direction to drive the gear 200 and gear segment 184, thereby rotating the movable base 180 about the axis 182 in a direction to shift the movable base 180 toward its original at rest position where the switch contacts 178 are out of engagement with the switch contacts 176.

If the sensor 168 is tilted so the arm 174 is to the right as viewed in FIG. 11, the center and left switch contacts 176 engage the contacts 178 to complete a connection between the conductors 188, 190, 192, 194. This energizes the motor 196 in a second or opposite direction of rotation and causes the output shaft 198 to rotate in an opposite direction to move the base 180 about its axis 182 toward its at rest position.

Figure 1:
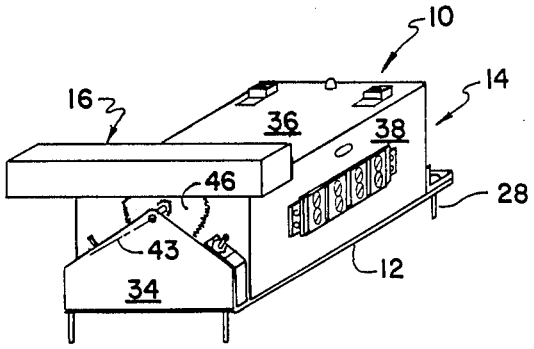
FIG. 1 is an isometric view of a movement sensor of this invention.
Figure 12:
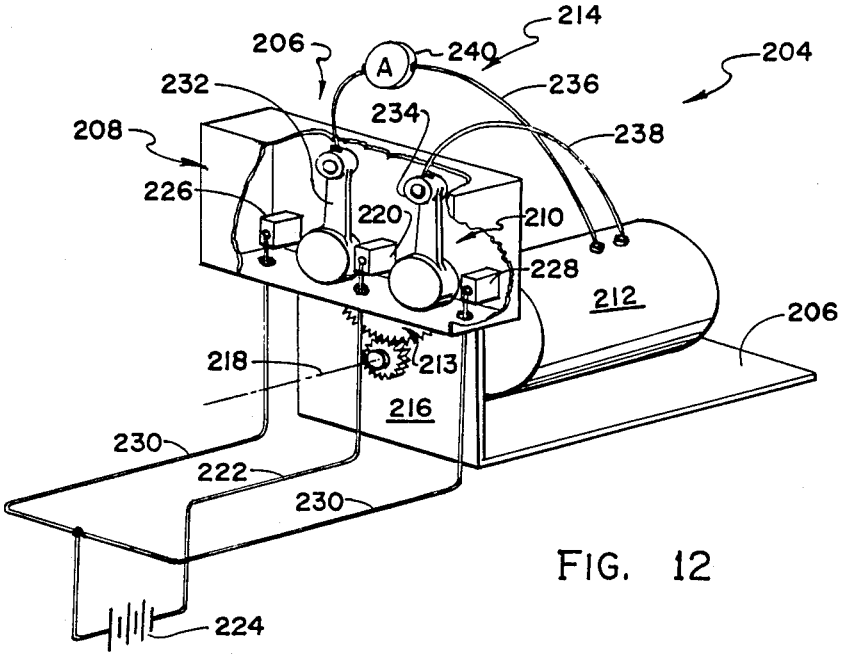
FIG. 12 is a schematic view of another embodiment of this invention.

Referring to FIG. 12, another embodiment 204 of this invention is illustrated and incorporates features of the embodiments of FIGS. 1 and 11. The movement detector 204 comprises, as major components, a base 206, a movable element or beam 206 carrying one or more pendulum type switches 208, 210, a motor 212, a gear reducer 213 and a circuit 214 connecting the switches 208, 210 and motor 212.

The base 206 includes an upturned end 216 mounting the beam 206 for rotation about an axis 218. The motor 212 is connected by the gear reducer 213 for rotating the beam 206 in either direction, depending on the drive direction of the motor 212. Thus, the detector 204 of FIG. 12 is, as heretofore described, substantially identical with the detector 10.

Instead of the level switches 18, 20, the detector 204 incorporates pendulum type switches 208, 210 similar to that shown in FIG. 11. The switches 208, 210 include a common contact 220 connected by a conductor 222 to one terminal of a battery 224. A pair of separate stationary contacts 226, 228 are mounted on the beam 206 and connected by conductors 230 to the other terminal of the battery 224. The contacts 226, 228 are placed in the path of movement of a pair of pendulum members 232, 234 which are electrically connected to conductors 236, 238 of the circuit 214 leading to the motor 212.

An alarm 202 may be provided in the circuit 214 of the sensor 204 in any suitable manner, to be energized upon closing of the pendulum switches 208, 210.

Operation of the movement sensor 204 should now be apparent. The sensor 204 is placed on or attached to the item sought to be protected. Usually, the beam 206 is initially tilted so the pendulum members 230, 232 complete a connection between the conductors 222, 230, 236, 238 depending on the direction the beam 206 is inclined to the horizontal. If the beam 206 is tilted down to the right as viewed in FIG. 12, the left pendulum member 232 engages the common contact 220 and the right pendulum member 235 engages the right contact 228 to complete a connection between the conductors 222, 230, 236, 238. This energizes the motor 212 in a first direction of rotation and causes the output thereof to drive the beam 206 in a direction toward its horizontal or at rest position where the pendulum members 232, 234 are out of engagement with the switch contacts 220, 226, 228.

If the sensor 204 is tilted so the beam 206 is down to the left as viewed in FIG. 12, the pendulum members 232, 234 engage the contacts 226, 220. This energizes the motor 212 in a second or opposite direction of rotation and causes the output thereof to tilt the beam 206 in the opposite direction toward its horizontal or at rest position.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A motion detector comprising a base having an element movably mounted thereon;

switch means, carried by the element, capable of discriminating between a first angular position of the element and a second angular position thereof;

circuit means connected to the switch means for energizing a remote device upon movement of the element from the first angular position toward the second angular position; and means responsive to movement of the element from the first angular position to the second angular position for moving the element from the second angular position back to the first angular position.

2. The motion detector of claim 1 wherein the first angular position is horizontal and the second angular position is inclined to the horizontal.

3. The motion detector of claim 1 wherein the remote device comprises an alarm and the means connected to the switch means comprises means for activating the alarm.

4. The motion detector of claim 1 wherein the element includes means mounting the element on the base for rotation about an axis and the means responsive to movement of the element comprises an output shaft connected to the element and a motor for rotating the output shaft.

5. The motion detector of claim 4 wherein the means responsive to movement of the element comprises a gear reducer providing the output shaft and having an input, the motor having an output connected to the gear reducer input.

6. The motion detector of claim 4 wherein the switch means comprises first and second level switches, and wherein the circuit means comprises means connecting the first and second level switches to the motor for driving the motor in a first rotational direction when the level switches detect tilting of the level switches in a second rotational direction opposite to the first rotational direction and connecting the first and second level switches to the motor for driving the motor in the second rotational direction when the level switches detect tilting of the level switches in the first rotational direction.

7. The motion detector of claim 6 wherein the first angular position is horizontal and the first and second level switches each comprise an insulating envelope providing a compartment, bottom, intermediate and upper conductors extending through the envelope into the compartment and a conductive liquid drop in the compartment for selectively connecting the bottom conductor to the intermediate or upper conductor in response to the orientation of the envelope, the envelopes being slightly angularly offset relative to each other.

8. The motion detector of claim 7 wherein the envelopes reside in parallel planes and converge toward each other.

9. The motion detector of claim 4 wherein the switch means comprises a nonconductive elongate envelope having a first pair of conductors extending through a first end thereof, a second pair of conductors extending through a second end thereof and a conductive liquid drop inside the envelope for electrically connecting the first pair of conductors or the second pair of conductors, the means responsive to movement of the element comprising the first mentioned motor connected to the first pair of conductors for moving the beam in a first rotational direction and a second motor connected to the second pair of conductors for moving the beam in a second rotational direction opposite from the first rotational direction.

10. The motion detector of claim 4 wherein the switch means comprises a nonconductive elongate envelope having a first pair of conductors extending through a first end thereof, a second pair of conductors extending through a second end thereof and a conductive liquid inside the envelope for electrically connecting the first pair of conductors or the second pair of conductors, the motor having means responsive to electrical communication between the first pair of conductors for moving the beam in a first rotational direction and responsive to electrical communication between the second pair of conductors for moving the beam in a second rotational direction opposite from the first rotational direction.

11. The motion detector of claim 1 wherein the switch means comprises a level switch having a non-conductive envelope, a plurality of conductive elements extending into the envelope and a conductive liquid drop in the envelope.

12. The motion detector of claim 11 wherein the envelope is elongate and generally horizontal and comprises a generally trough shaped bottom wall on which the drop moves, the bottom wall providing a downwardly extending bulge intermediate the ends of the envelope for receiving the conductive liquid drop at a location out of contact with all of the conductive elements.

13. The motion detector of claim 1 wherein the first angular position is vertical and the second angular position is inclined to the vertical.

14. The motion detector of claim 13 wherein the switch means comprises a pendulum element mounted for rotation on the movably mounted element about a horizontal axis and carrying a first switch member, a second switch member carried on the movably mounted element for engagement with the first switch member.

15. The motion detector of claim 13 wherein the switch means comprises first and second pendulum switches, and wherein the circuit means comprises means connecting the first and second pendulum switches to the motor for driving the motor in a first rotational direction when the pendulum switches detect tilting of the pendulum switches in a second rotational direction opposite to the first rotational direction and connecting the first and second pendulum switches to the motor for driving the motor in the second rotational direction when the pendulum switches detect tilting of the pendulum switches in the first rotational direction.

* * * * *